US010411408B2

(12) United States Patent
Wu et al.

(10) Patent No.: US 10,411,408 B2
(45) Date of Patent: Sep. 10, 2019

(54) CONNECTOR ASSEMBLY WITH AN IMPROVED LATCH MEMBER EASY TO OPERATE

(71) Applicant: FOXCONN INTERCONNECT TECHNOLOGY LIMITED, Grand Cayman (KY)

(72) Inventors: Jerry Wu, New Taipei, CA (US); Jun Chen, Kunshan (CN); Xiao Fan, Kunshan (CN); Zhao-Tao Jiang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/965,743

(22) Filed: Apr. 27, 2018

(65) Prior Publication Data

US 2018/0323544 A1 Nov. 8, 2018

(30) Foreign Application Priority Data

May 3, 2017 (CN) ..... 2017 1 0302766

(51) Int. Cl.
*H01R 4/50* (2006.01)
*H01R 13/639* (2006.01)
(Continued)

(52) U.S. Cl.
CPC ..... *H01R 13/639* (2013.01); *H01R 13/6272* (2013.01); *H01R 13/6275* (2013.01);
(Continued)

(58) Field of Classification Search
CPC .. H01R 13/639; H01R 24/62; H01R 13/6582; H01R 12/7064; H01R 13/6272; H01R 12/7076; H01R 2107/00
(Continued)

(56) References Cited

U.S. PATENT DOCUMENTS 5,564,939 A * 10/1996 Maitani ..... H01R 13/6335 439/352
5,634,809 A * 6/1997 Hirai ..... H01R 13/6275 439/352

(Continued)

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

A connector assembly includes: an insulative housing defining a receiving room communicating with outside; plural contacts retained in the insulative housing; and a latch member assembled on a rear side of the insulative housing, latch member comprising a locking portion received in the receiving room and a pressing portion connected to a rear end of the locking portion; wherein the latch member further comprises a resilient portion connected to a rear end of the pressing portion and a fixing portion connected to a rear end of the resilient portion and fixed relative to the insulative housing, the locking portion defines a locking section on a front end thereof to lock with a docking connector, and the locking portion is movable within the receiving room by applying an external force to the pressing portion, thereby unlocking the locking section from the docking connector.

11 Claims, 10 Drawing Sheets

(51) Int. Cl.

| | |
|---|---|
| ***H01R 13/627*** | (2006.01) |
| ***H01R 24/62*** | (2011.01) |
| *H01R 12/70* | (2011.01) |
| *H01R 107/00* | (2006.01) |
| *H01R 13/6582* | (2011.01) |

(52) U.S. Cl.
CPC ..... *H01R 24/62* (2013.01); *H01R 12/7064* (2013.01); *H01R 12/7076* (2013.01); *H01R 13/6582* (2013.01); *H01R 2107/00* (2013.01)

(58) Field of Classification Search
USPC ..... 439/676, 352, 353, 357, 76.1
See application file for complete search history.

(56) References Cited

U.S. PATENT DOCUMENTS 5,997,323 A * 12/1999 Youn ..... H01R 13/6275 439/157
6,592,391 B1 * 7/2003 Wu ..... H01R 13/6275 439/352
8,303,325 B2 * 11/2012 Yang ..... H01R 13/635 439/352
8,439,706 B2 * 5/2013 Sytsma ..... H01R 13/65802 439/607.19
8,506,331 B2 * 8/2013 Wu ..... H01R 13/6658 439/353
8,770,990 B2 * 7/2014 Sytsma ..... H01R 9/034 439/76.1
9,397,442 B2 7/2016 Molex
2006/0160429 A1 * 7/2006 Dawiedczyk ..... H01R 12/7005 439/676
2011/0195595 A1 * 8/2011 Wu ..... H01R 13/6275 439/370
2013/0045642 A1 * 2/2013 Wu ..... H01R 24/30 439/676
2016/0126672 A1 * 5/2016 Kawamura ..... H01R 13/633 439/153

* cited by examiner

CONNECTOR ASSEMBLY WITH AN IMPROVED LATCH MEMBER EASY TO OPERATE

BACKGROUND OF THE INVENTION

1. Field of the Invention

The present invention relates to a connector assembly, and more particularly to a connector assembly with an improved latch member conducive to be operated. This application discloses the same type connector with the copending application Ser. No. 15/944,795 filed on Apr. 4, 2018.

2. Description of the Related Art

U.S. Pat. No. 9,397,442, issued on Jul. 9, 2016, discloses an electrical connector including an insulative housing, a plurality of contacts retained in the insulative housing, a shielding case enclosing the insulative housing, a latch member assembled in the insulative housing, and an outer cover covering the shielding case and the rear end of the insulative housing. The latch member includes two spaced locking portions and a fixing portion connecting between the two locking portions. Each of the locking portions defines two pressing points, and the outer cover defines a pressing portion corresponding to the pressing points. Pressing the pressing point by applying an external force to the operating portion achieves unlocking of the electrical connector assembly.

However, when an external force acts on the pressing portion, it must be accurately pressed to a position corresponding to the pressing point to be effectively unlocked. Therefore, in the prior art, the pressing position is often inaccurate, resulting in an invalid operation and unable to be successfully unlocked.

Therefore, it is desired to have a connector assembly with an improved latch member that is easy to operate to meet the unlocking requirements for cable connector assemblies.

BRIEF SUMMARY OF THE INVENTION

An object of the present invention is to provide a connector assembly with an improved latch member easy to operate.

In order to achieve above-mentioned object, a connector assembly comprises: an insulative housing defining a receiving room communicating with outside; a plurality of contacts retained in the insulative housing; and a latch member assembled on a rear side of the insulative housing, latch member comprising a locking portion received in the receiving room and a pressing portion connected to a rear end of the locking portion; wherein the latch member further comprises a resilient portion connected to a rear end of the pressing portion and a fixing portion connected to a rear end of the resilient portion and fixed relative to the insulative housing, the locking portion defines a locking section on a front end thereof to lock with a docking connector, and the locking portion is movable within the receiving room by applying an external force to the pressing portion, thereby unlocking the locking section from the docking connector.

The present invention also provides a connector assembly comprising: an insulative housing; a plurality of contacts retained in the insulative housing for electrically connecting with a docking connector; an outer case enclosing a rear end of the insulative housing; and a latch member assembled in the outer case and comprising a locking portion locked with the docking connector and exposed to a front side of the outer case and a pressing portion connected to a rear end of the locking portion; wherein the latch member further comprises a resilient portion connected to a rear end of the pressing portion and a fixing portion connected to a rear end of the resilient portion and fixed relative to the insulative housing, the resilient portion defines at least one opening in a middle portion to form at least two connecting bridges on both sides of the opening which are connected between the pressing portion and the fixing portion, the outer case defines an operating portion at a position corresponding to the pressing portion, and upon applying an external force to the operating portion the operating portion presses the pressing portion to drive the locking portion to unlock the locking from the docking connector.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
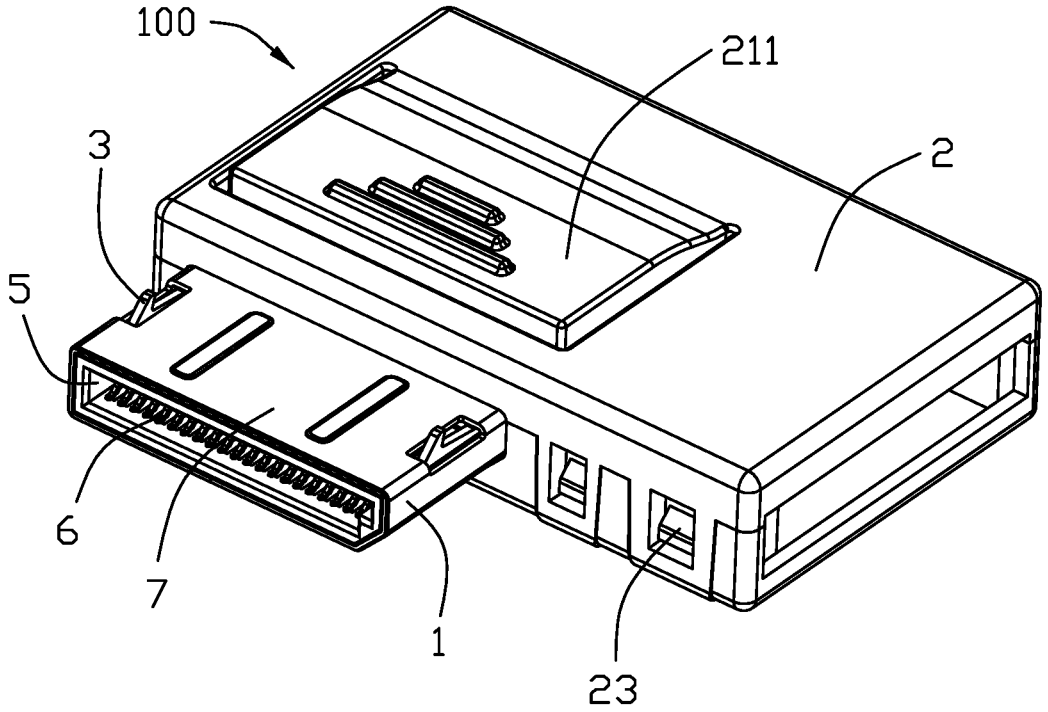
FIG. 1 is a perspective view showing a connector assembly in accordance with a preferred embodiment of the present invention.
Figure 2:
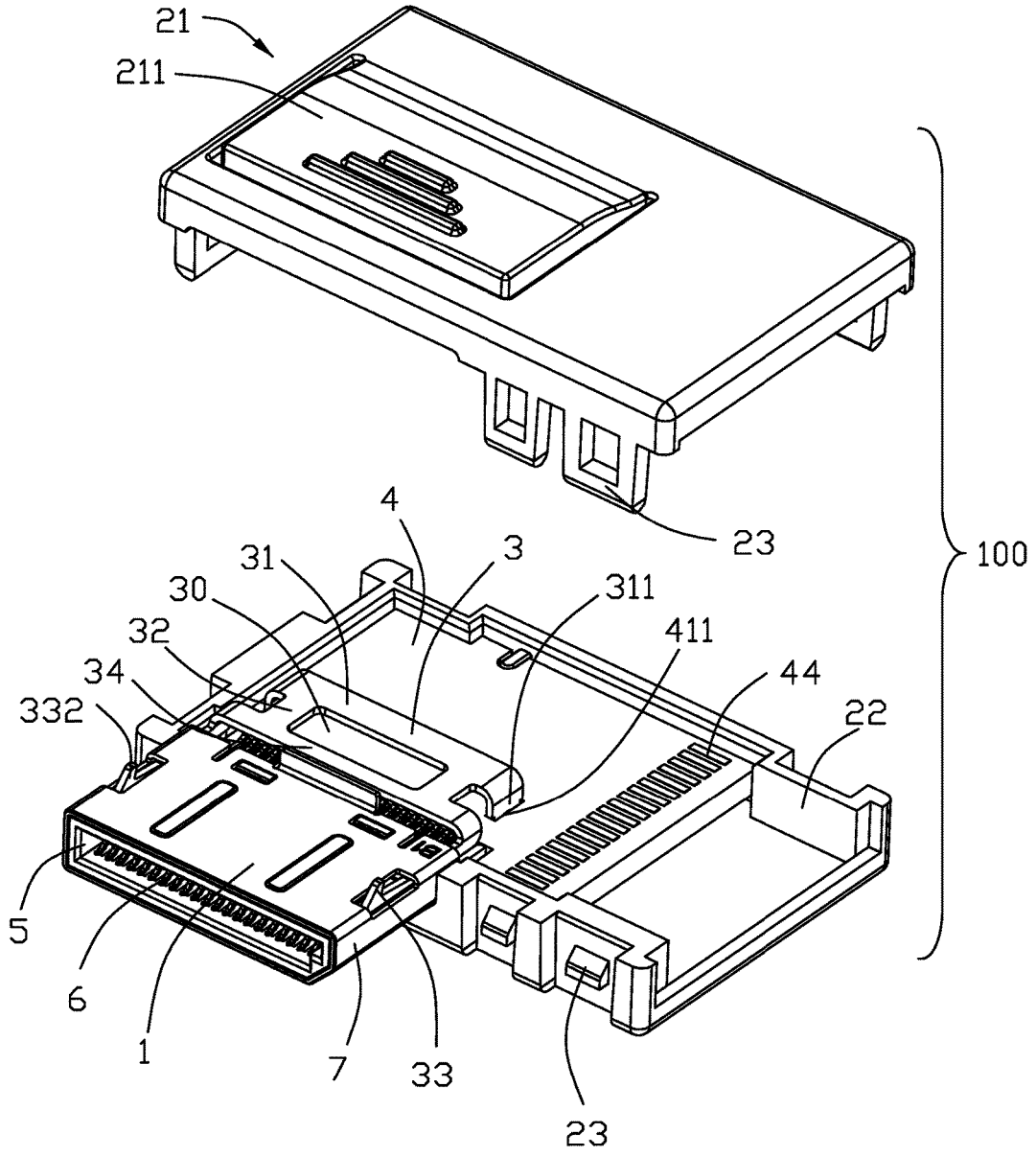
FIG. 2 is a partially exploded view showing the connector assembly shown in FIG. 1.
Figure 3:
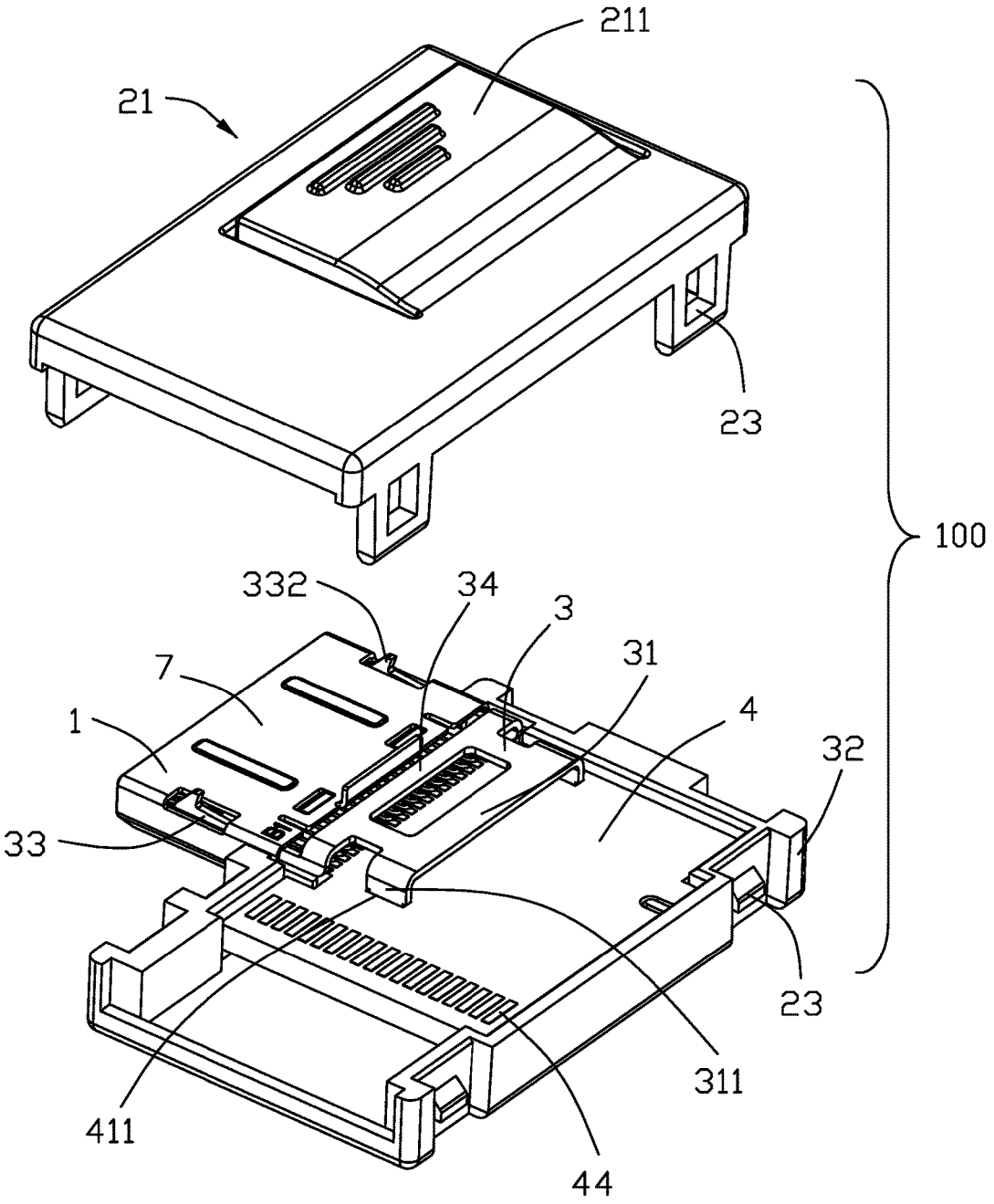
FIG. 3 is a partially exploded view similar to FIG. 2, but from a different perspective.
Figure 4:
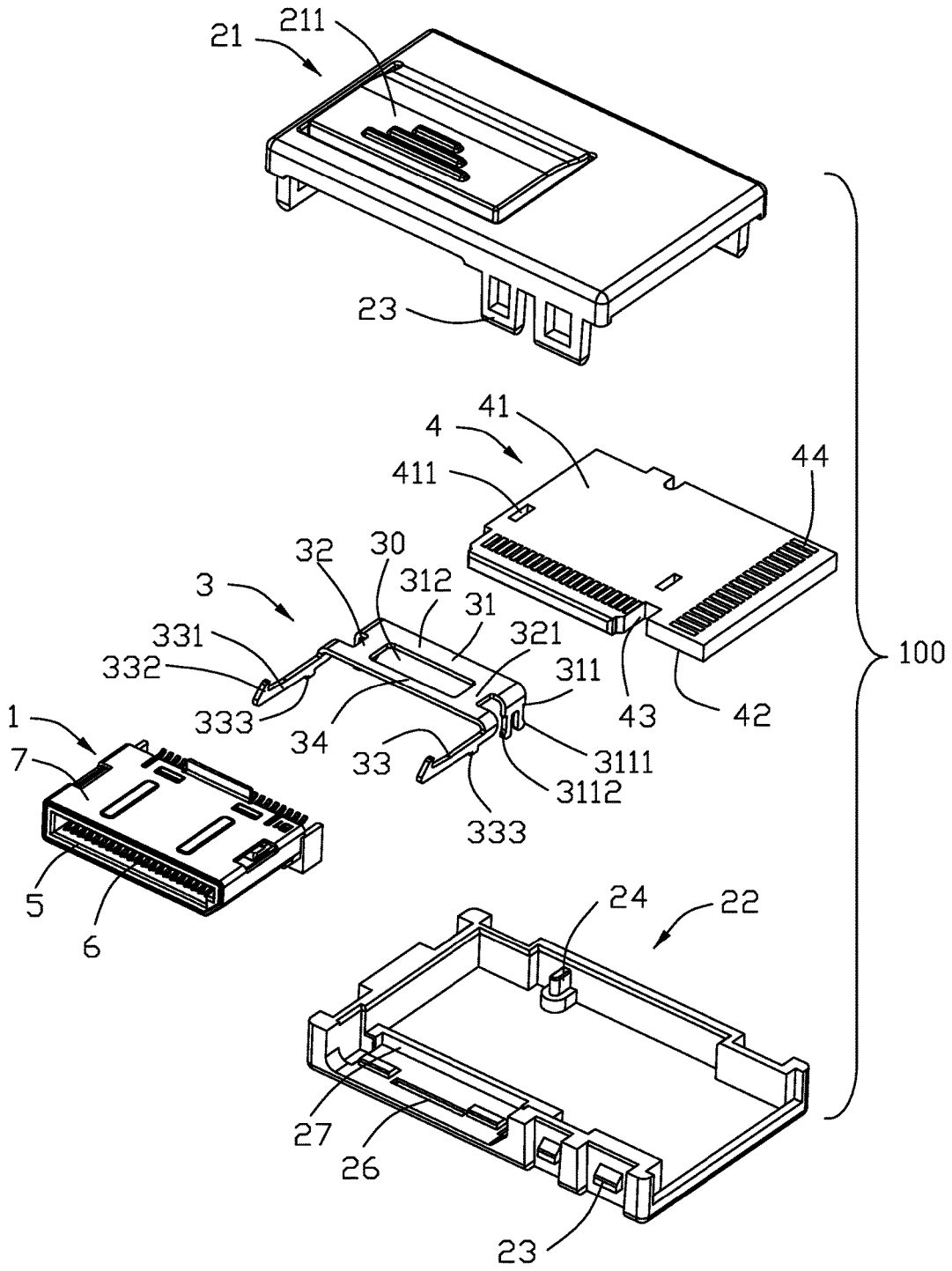
FIG. 4 is a partially exploded view showing the electrical connector shown in FIG. 2.
Figure 5:
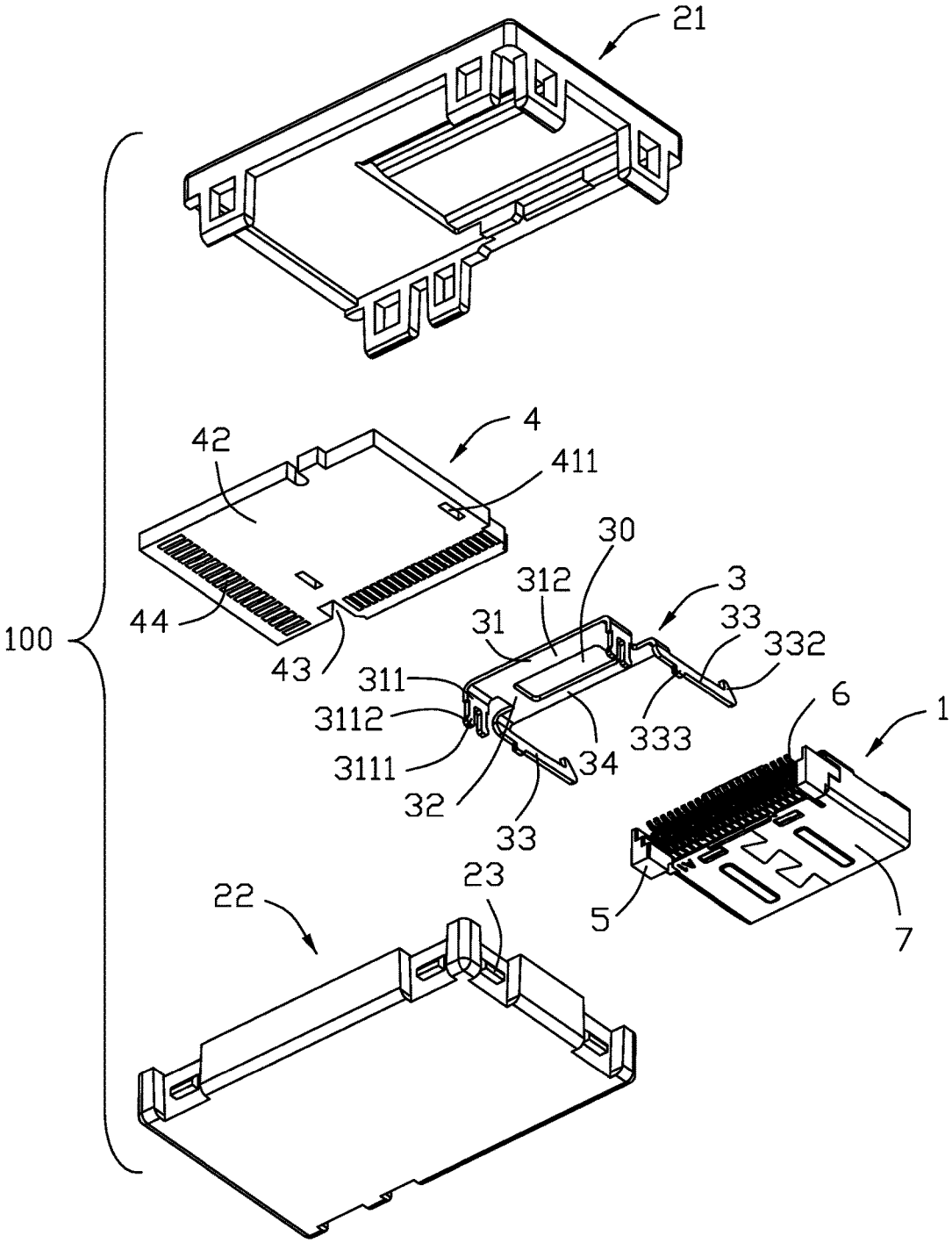
FIG. 5 is a partially exploded view similar to FIG. 4, but from a different perspective.

Reference will now be made to the drawing figures to describe a preferred embodiment of the present invention in detail.

Referring to FIGS. 1 to 7, the electrical connector assembly 100 according to the present invention, including an electrical connector 1, a latch member 3 received in the electrical connector 1, a printed circuit board 4 assembled on a rear end of the electrical connector 1, and an outer case 2 enclosing the electrical connector 1 and the printed circuit board 4.

Figure 6:
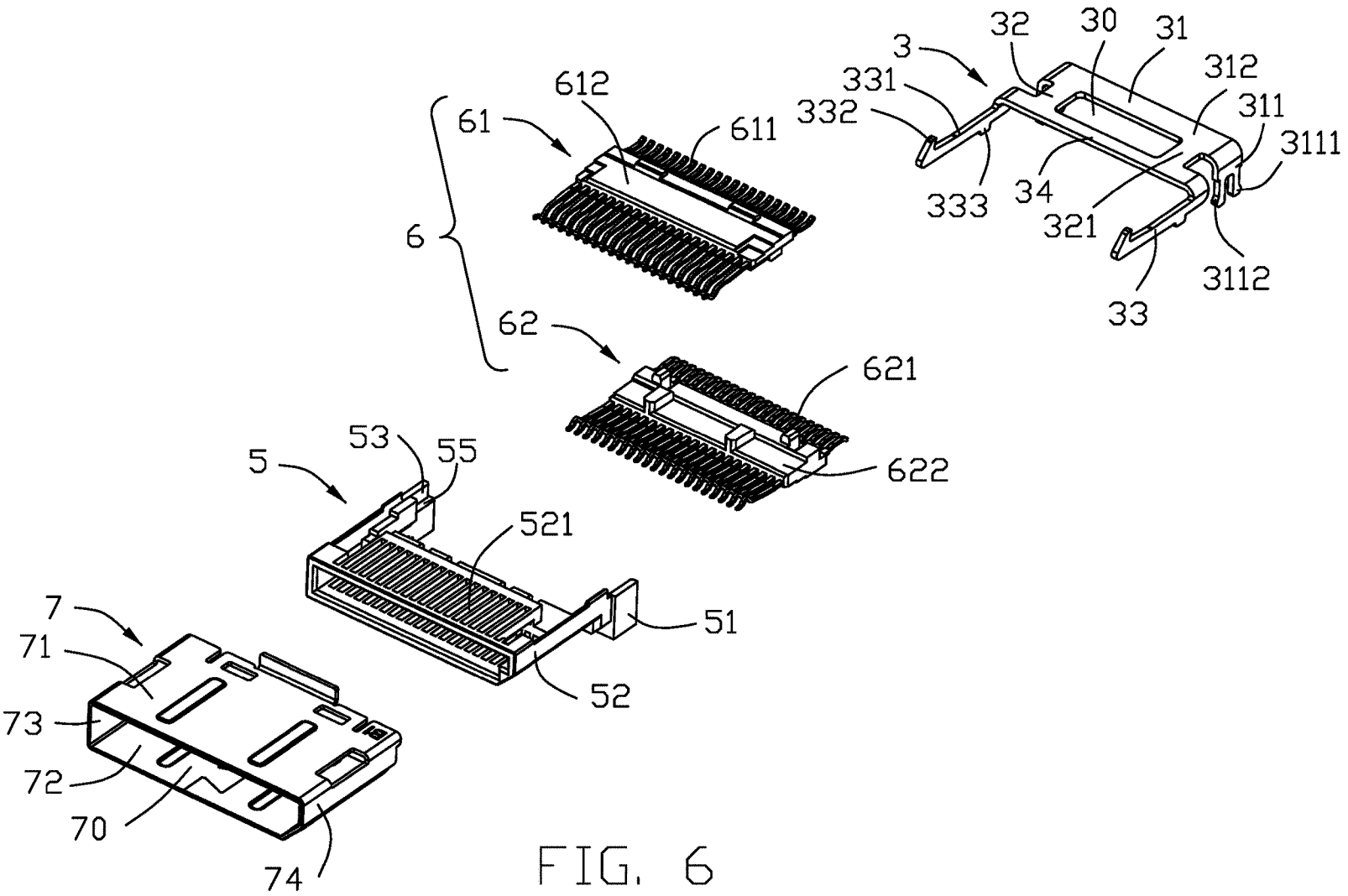
FIG. 6 is an exploded view showing the electrical connector and the latch member shown in FIG. 4.
Figure 7:
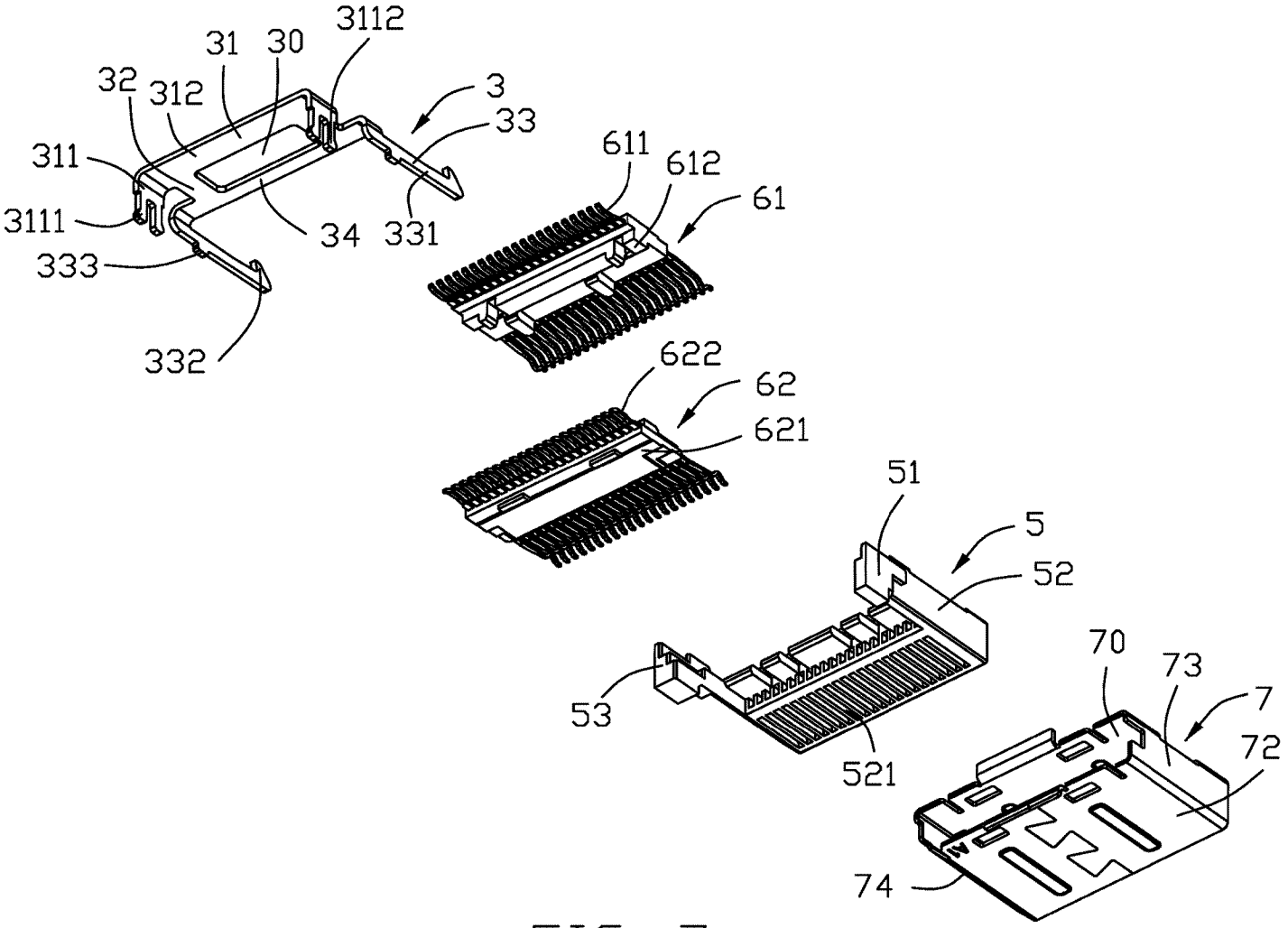
FIG. 7 is an exploded view similar to FIG. 6, but from a different perspective.
Figure 8A:
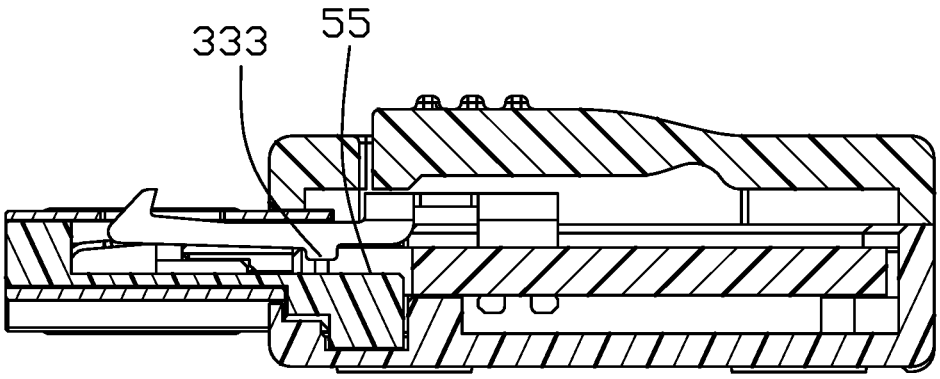
FIG. 8(A) is a cross-sectional view of the connector assembly shown in FIG. 1 when the latch member is in a relaxed manner.
Figure 8B:
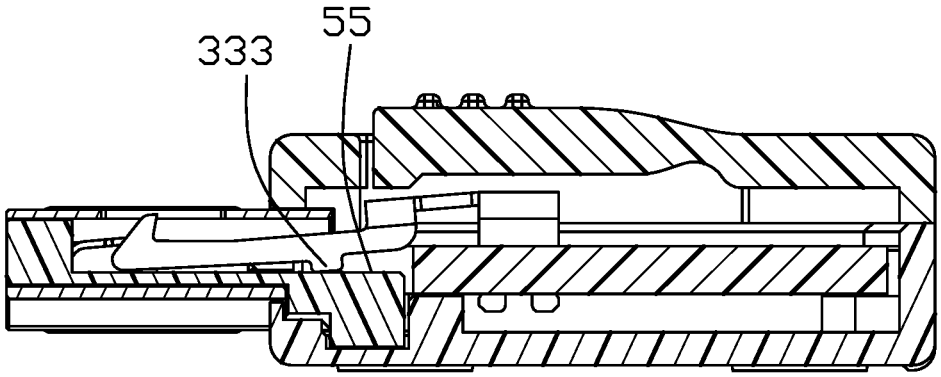
FIG. 8(B) is another cross-sectional view of the connector assembly shown in FIG. 1 when the latch member is in a pressed manner.
Figure 9:
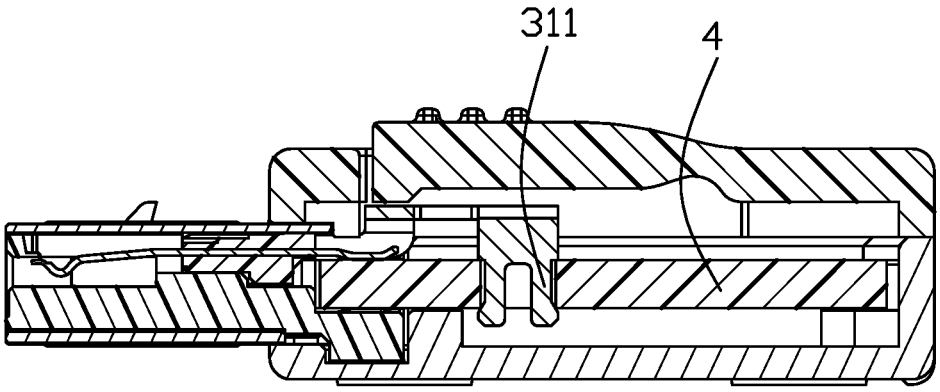
FIG. 9 is a cross-sectional view of the connector assembly shown in FIG. 1 to show the latch member is retained to the printed circuit board.

Referring to FIGS. 6 and 7, the electrical connector 1 includes an insulative housing 5, a contact module 6 received in the insulative housing 5, and a metallic shielding case 7 enclosing the insulative housing 5. The contact module 6 includes a first terminal module 61 and a second terminal module 62. The first terminal module 61 includes a first insulative member 612 and a plurality of first contacts 611 received in the first insulative member 612. The second terminal module 62 includes a second insulative member 622 and a plurality of second contacts 621 received in the second insulative member 622. The first contacts 611 and the second contacts 621 are collectively referred to as contacts and have corresponding rear tail sections (not labeled) soldered upon the printed circuit board 4 and front contacting sections (not labeled) extending into a mating cavity (not labeled) of the housing 5 for mating with a complementary connector (not shown).

Referring to FIGS. 6 to 7, the latch member 3 is a one-piece type. The latch member extending along a front-to-back direction and deflectable in a vertical direction perpendicular to the front-to-back direction in a cantilevered manner, 3 includes two locking portions 33 spaced apart from each other, a pressing portion 34 connecting two rear ends of the two locking portions 33, a pair of resilient portions 32 extending backward from a rear side of the pressing portion 34 and spaced apart from each other, and a fixing portion 31 connecting two rear ends of the two the elastic portion 32. The pair of locking portions 33 is parallel to each other along a front-to-back direction. Each of the locking portions 33 includes an elastic section 311 connecting with the pressing portion 34, a stopping section/tab 333 protruding downward from a part of the elastic section 331 and a locking section/head 332 protruding upward from a front end of the elastic section 331. The pressing portion 34 is an elongated structure connecting the two locking portions 33 so that pressing any portion of the pressing portion 34 can promote the movement of the locking portions 33. In the present embodiment, the locking portions is The latching portion 33 is a plate-like structure extending in a vertical plane, while the pressing portion 34 is a flat plate-like structure extending in a horizontal plane perpendicular to the vertical plane. The pressing portion 34 connects the top ends of the two rear ends of the locking portions 33. In other embodiments, the shapes of the pressing portion 34 and the locking portions 33 may be determined according to actual conditions. The resilient portion 32 connects the pressing portion 34 and the fixing portion 31, to provide the elastic force when the pressing portion 34 receives a force, so that only a small pressing force is required when unlocking the locking portion 33. In the present embodiment, the resilient portions 32 are a pair of spaced connecting bridges 321 extending along the front-to-back direction, each of which is connected between the pressing portion 34 and the fixing portion 31. The pair of connecting bridges 321, the pressing portion 34 and the fixing portion 31 together form a rectangular opening 30, and the position of the connecting bridges 321 does not exceed the horizontal outside of the fixing portion 31 and the pressing portion 34. In other embodiment, the resilient portions 32 may be other structures, for example only one connection bridge 321 or a number of connecting bridges 3 set according to the actual situation in corresponding locations, etc. In the prefer embodiment, the resilient portion 32 may be provided with at least one connecting bridge 321, and the sum of the widths of all the connecting bridges 321 is smaller than the distance between the two locking portions 33. The fixing portion 31 includes a main body 312 connecting with the resilient portion 342 and at least a fixing foot 311 extending from the main body 312. In the present embodiment, the fixing portion 31 includes a pair of fixing legs 311 and a main body 312 connecting between the fixing legs 311. The fixing legs 311 are disposed perpendicular to the main body 312, and the main body 312 connecting to a top end of each fixing foot 311. Each of the fixing foot 311 includes a pair of fixing legs 3111 extending vertically downwards and spaced from each other. Each of the fixing legs 3111 defines a plurality of barbs 3112 on a free end thereof to provide retention force with the printed circuit board 4.

Referring to FIGS. 6 and 7, the insulative housing 5 includes a base portion 51, a tongue portion 52 and a receiving room 53 for receiving the latch member 3. The tongue portion 52 defines a plurality of contact slots 521 for receiving the contacts. A top portion of the receiving room 53 is communicated with an outer side, to allow the locking portion 33 to move therein along the vertical direction. The shielding case 7 includes a upper case 71, a lower case 72, a left case 73, a right case 4 and an accommodating space 70 surrounded by upper, lower, left, and right cases 71, 72, 73, 74.

Referring to FIGS. 1 to 5, the printed circuit board 4 includes a top surface 41, a bottom surface 42, a containment gap 43 recessed from front to back for accommodating a rear portion of the corresponding locking portion 33 when the latch member 3 is depressed/deflected, a plurality of receiving holes 411 for receiving the fixing legs 311 and a plurality of conductive pads 44 exposing on the top surface 41 and the bottom surface 42. The outer case 2 includes an upper cover 21 and a lower cover 22 assembled to each other. The upper cover 21 and the lower cover 22 are respectively provided with interlocking locking devices 23 and a plurality of limiting posts 24 for limiting the printed circuit board 4. The outer case 2 further includes an opening 26 for the shield case 7 to pass through and limiting structure 27 for limiting the shielding case 7 and the insulative housing 5. The upper cover 21 is provided with an operation portion 211 for a user to apply an external force. The operation portion 211 is provided corresponding to the pressing portion 34 so that the operation portion 211 applies a force to the pressing portion 34 when an external force acts on the operation portion 211. In the present embodiment, the operation portion 211 is disposed on a top side of the pressing portion 34, when an external force is pressed against the operating portion 211, the operating portion 211 acts on the pressing portion 34 to unlock the locking portion 33.

During assembling, the contact module 6 is received in the insulative housing 5; the latch member 3 is received in the receiving room 53 of the insulative housing 5; the insulative housing 5 assembled with the contact module 6 and the latch member 3 is fixed in the shielding case 7; the printed circuit board 4 is assembled on a rear end of the insulative housing 5; the fixing legs 311 of the latch member 3 are passed through the receiving hole 411 and the barbs 3112 protrudes from the circuit board 4, and than the barbs 3112 are soldered and fixed to the printed circuit board 4 by welding; the contacts are electrically connected on the corresponding conductive pads of the printed circuit board 4; the outer cover 2 are enclosed on the printed circuit board 4 and a rear end of the shielding case 7. In the present invention, the pressing portion 34 of the latch member 32 is long strip-shaped, so that the unlocking of the locking portion 33 can be realized by applying an external force at any portions of the pressing portion 34, avoiding that in the prior art, only one pressing point is provided on each locking portion, resulting in the defect that the pressing failure occurs when the pressing point is not found during pressing. In addition, in the present invention, the resilient portion 32 is designed to connect between the fixing portion 31 and the pressing portion 34, so the resilient portion 32 equivalents to one power arm, and when the pressing portion 34 receives a pressing force, the increase of the power arm length can reduce the pressing force according to the lever theorem, so that the application of a smaller external force can meet the unlocking requirements of the latching portion 33 of the electrical connector assembly 100. Notably, the stopping section 333 abuts against the corresponding abutment surface 55 of the housing 5 for avoiding excessive deflection of the latch member 3. Briefly speaking, in the instant invention the distance between the two fixing legs 311 is larger than that between the pair of locking portions 33 in the transverse direction perpendicular to both the front-to-back direction and the vertical direction for assuring stability of the whole latch member 3 during operation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A connector assembly comprising:

an insulative housing;

a plurality of contacts retained in the insulative housing for electrically connecting with a docking connector;

a printed circuit board connected to the plurality of contacts;

an outer case enclosing a rear end of the insulative housing and the printed circuit board; and a latch member assembled in the outer case and comprising a locking portion locked with the docking connector and exposed to a front side of the outer case and a pressing portion connected to a rear end of the locking portion; wherein the latch member further comprises a resilient portion connected to a rear end of the pressing portion and a fixing portion connected to a rear end of the resilient portion and fixed to the printed circuit board, the resilient portion defines at least one opening in a middle portion thereof to form at least two connecting bridges on both sides of the opening which are connected between the pressing portion and the fixing portion, the outer case defines an operating portion at a position corresponding to the pressing portion, and upon applying an external force to the operating portion the operating portion presses the pressing portion to drive the locking portion to unlock the locking portion from the docking connector.

2. The connector assembly as described in claim 1, wherein the latch member includes a pair of locking portions, each locking portion includes an elastic section and a locking section defined on a front end of the elastic section, and the two elastic sections are respectively connected to two opposite ends of the pressing portion.

3. The connector assembly as described in claim 2, wherein the resilient portion extends up to the locking portion in a horizontal direction perpendicular to the front-to-back direction.

4. The connector assembly as described in claim 2, wherein the pressing portion is in a horizontal plane which is higher than the locking portion.

5. An electrical connector assembly comprising:

an outer case;

a printed circuit board disposed in the outer case;

an electrical connector retained to the outer case and including:

an insulative housing located in front of the printed circuit board;

a metallic shield enclosing the housing;

a plurality of contacts disposed in the housing with corresponding rear tail sections secured to the printed circuit board; and a deflectable latch member extending along a front-to-back direction in a cantilevered manner, and including a rear fixing portion retained to the printed circuit board, a pair of front locking portions with, at front ends thereof, corresponding locking heads extending through the metallic shield outwardly in a vertical direction perpendicular to said front-to-back direction, and a pressing portion between said rear fixing portion and the front locking portions in the front-to-back direction; wherein the outer case forms a deflectable operation portion confronting said pressing portion in the vertical direction.

6. The electrical connector assembly as claimed in claim 5, wherein the printed circuit board forms a hole through which said rear fixing portion extends in the vertical direction.

7. The electrical connector assembly as claimed in claim 5, wherein each of said pair of front locking portions further forms a stopping tab opposite to the corresponding locking head in the vertical direction and abutting against an abutment surface formed on the housing when the latch member is depressed in the vertical direction for anti-overstress.

8. The electrical connector assembly as claimed in claim 5, wherein said printed circuit board forms a containment gap to receive a rear portion of the corresponding locking portion when the latch member is depressed in the vertical direction.

9. The electrical connector assembly as claimed in claim 5, wherein said housing forms a base, and each of said locking portions is located between the base and the printed circuit board in a transverse direction perpendicular to both said front-to-back direction and said vertical direction.

10. The electrical connector assembly as claimed in claim 5, wherein said rear fixing portion includes a pair of fixing legs spaced from each other in a transverse direction perpendicular to both said front-to-back direction and said vertical direction.

11. An electrical connector assembly comprising:

an outer case;

a printed circuit board disposed in the outer case;

an electrical connector retained to the outer case and including:

an insulative housing located in front of the printed circuit board;

a metallic shield enclosing the housing; and a plurality of contacts disposed in the housing with corresponding rear tail sections secured to the printed circuit board; and a deflectable latch member extending along a front-to-back direction in a cantilevered manner, and including a rear fixing portion retained to the printed circuit board, a pair of front locking portions with, at front ends thereof, corresponding locking heads extending through the metallic shield outwardly in a vertical direction perpendicular to said front-to-back direction, and a pressing portion between said rear fixing portion and the front locking portions in the front-to-back direction; wherein the outer case forms a deflectable operation portion confronting said pressing portion in the vertical direction; and said rear fixing portion includes a pair of fixing legs spaced from each other with a first distance in a transverse direction perpendicular to both said front-to-back direction and said vertical direction, said first distance being larger than a second distance defined between the pair of locking portions in said transverse direction.

* * * * *